United States Patent [19]

Shinomiya

[11] Patent Number: 4,472,675

[45] Date of Patent: Sep. 18, 1984

[54] REFERENCE VOLTAGE GENERATING CIRCUIT

[75] Inventor: Kohji Shinomiya, Itami, Japan

[73] Assignee: Mitsubishi Denki Kabushiki Kaisha, Tokyo, Japan

[21] Appl. No.: 435,376

[22] Filed: Oct. 20, 1982

[30] Foreign Application Priority Data

Nov. 6, 1981 [JP] Japan ..... 56-179501

[51] Int. Cl.[3] ..... G05F 3/20

[52] U.S. Cl. ..... 323/314; 323/907

[58] Field of Search ..... 323/312–316, 323/907; 307/296 R, 297, 310

[56] References Cited

U.S. PATENT DOCUMENTS

| | | | |
|---|---|---|---|
| 3,617,859 | 11/1971 | Dobkin et al. | 323/907 X |
| 4,091,321 | 5/1978 | Hanna | 323/907 X |
| 4,100,477 | 7/1978 | Tam | 323/314 |
| 4,263,519 | 4/1981 | Schade, Jr. | 323/314 X |
| 4,352,056 | 9/1982 | Cave et al. | 323/907 X |
| 4,359,680 | 11/1982 | Hellums et al. | 323/313 |

OTHER PUBLICATIONS

Robt. Dobkin, "1.2 Volt Reference", from National Semiconductor Application Note 56, Dec. 1971.

National Semiconductor Inc. Catalog, (LM113/LM313), pp. 2–8 through 2–10.

Michael P. Timko, "A Two-Terminal IC Temperature Transistor", IEEE Journal of Solid-State Circuits, vol SC-11, No. 6, Dec. 1976.

Dervent Publications, "Electrical Patents Index Profile Booklet", Abstracts of U.S. Pat. No. 4,250,445, 4,249,122 & U.S. Ser. No. 119,539.

*Primary Examiner*—Peter S. Wong

*Attorney, Agent, or Firm*—Lowe, King, Price & Becker

[57] ABSTRACT

A reference voltage generating circuit comprises a circuit (20) for generating a current having a positive temperature coefficient, a circuit (30) for generating a current having a negative temperature coefficient and a circuit (Q7, Q13, R3) for synthesizing both currents and converting the synthesized current into a reference voltage. The circuit (20) for generating a current having a positive temperature coefficient converts a difference voltage between respective base-emitter voltages of two transistors (Q2, Q3) included therein, both bases of which are connected to each other, into a current through a resistor (R2), while a negative feedback is applied by utilizing a current mirror (Q9~Q13). The circuit (30) for generating a current having a negative temperature coefficient converts a voltage between a base and an emitter of a single transistor (Q1) into a current through a resistor (R1) while a negative feedback is applied by utilizing a current mirror (Q5~Q7). The current having a positive temperature coefficient and the current having a negative temperature coefficient are synthesized to become a temperature compensated current which is converted into a reference voltage by a resistor (R3). Temperature coefficients of the resistors (R1, R2, R3) are set to be equal and thus are cancelled.

5 Claims, 4 Drawing Figures

REFERENCE VOLTAGE GENERATING CIRCUIT

BACKGROUND OF THE INVENTION

1. Field of the Invention

The present invention relates to a reference voltage generating circuit for generating a constant voltage independent of a variation of a voltage of a power supply thereof, a change of an ambient temperature and the like.

2. Description of the Prior Art

FIG. 1 shows an example of a conventional reference voltage generating circuit formed in a semiconductor integrated circuit. A voltage of a power source is applied between terminals T1 and T2. A reference voltage is also withdrawn between the terminals T1 and T2. The terminal T2 is a terminal on the ground side.

FIG. 2 is a basic circuit indicating a basic principle of a conventional reference voltage generating circuit. The voltage of a power source is applied between the terminals T1 and T2. A reference voltage is withdrawn between the terminals T3 and T2. The terminal T2 is a terminal on the ground side. A basic principle of the conventional reference voltage generating circuit will be described in the following with reference to FIG. 2.

A base of a transistor Q21 is connected to a base of a transistor Q22. The transistor Q21 has a collector connected to the base thereof so that the transistor Q21 has a diode function. Further, emitters of these transistors are connected to each other through a resistor R23. The transistor Q21 is operated with a relatively large current density J1 whereas the transistor Q22 is operated with a relatively small current density J2, for example, J2=1/10·J1. A difference, $\Delta V_{BE}$, between a base-emitter voltage of the transistor Q21 and a base-emitter voltage of the transistor Q22 is generally represented by $$\Delta V_{BE} = \frac{kT}{q} \ln \frac{J1}{J2} \tag{1}$$

where k indicates Boltzmann's constant, T indicates an absolute temperature and q indicates the charge of an electron.

$\Delta V_{BE}$ is applied to the resistor R23. If and when a current amplification factor of the transistor Q22 is sufficiently large, a current determined by the $\Delta V_{BE}$ and the resistor R23 becomes equal to a collector current $I_{C22}$ of the transistor Q22. Accordingly, the equation $I_{C22}=\Delta V_{BE}/R23$ is established. Thus, a drop voltage $V_{R22}$ of the resistor R22 connected to the collector of the transistor Q22 becomes $$V_{R22} = \frac{R22}{R23} \cdot \Delta V_{BE} \tag{2}$$

On the other hand, the collector current $I_{C22}$ of the transistor Q22 is applied to a base of a transistor Q23 and thus an amplified current flows through the transistor Q23. A base-emitter voltage $V_{BE}$ of the transistor Q23 is generally represented by $$V_{BE} = V_{g0}\left(1 - \frac{T}{T_0}\right) + V_{BE0} \cdot \frac{T}{T_0} + \frac{nkT}{q} \ln \frac{T_0}{T} + \tag{3}$$

-continued $$\frac{kT}{q} \ln \frac{I_c}{I_{c0}}$$

where $V_{g0}$ indicates an extrapolation voltage of an energy band gap inherent to a semiconductor material at T=0° K., n is a constant which is dependent on a manufacturing condition of a transistor, $I_C$ indicates a collector current and $I_{C0}$ indicates a collector current at T=0° K. Further, $V_{BE0}$ indicates a base-emitter voltage at T=0° K. The last two terms in the equation (3) are negligible since these terms is sufficiently small to a variation of a collector current $I_C$ at an absolute temperature. Thus, the equation (3) is briefly represented in the following.

$$V_{BE} = V_{g0}\left(1 - \frac{T}{T_0}\right) + V_{BE0} \cdot \frac{T}{T_0} \tag{4}$$

One end of the resistor R22 is connected to a terminal T3 and the other is connected to the base of the transistor Q23. An emitter of the transistor Q23 is connected to the terminal T2. Accordingly, a reference voltage $V_{ref}$ withdrawn between the terminals T3 and T2 is evaluated from the following equation.

$$V_{ref} = V_{R22} + V_{BE} \tag{5}$$

Substituting the equations (1), (2) and (4) for the equation (5), $$V_{ref} = \frac{R22}{R23} \cdot \frac{kT}{q} \ln \frac{J1}{J2} + V_{g0}\left(1 - \frac{T}{T_0}\right) + V_{BE} \cdot \frac{T}{T_0} \tag{6}$$

is obtained.

In order to evaluate a temperature coefficient of the reference voltage $V_{ref}$, differentiating the equation (6) with respect to an absolute temperature T, the following equation $$\frac{\partial V_{ref}}{\partial T} = \frac{R22}{R23} \cdot \frac{k}{q} \ln \frac{J1}{J2} - \frac{V_{g0}}{T_0} + \frac{V_{BE0}}{T_0}$$

is obtained. In order for the variation of the reference voltage $V_{ref}$ due to a temperature to be 0, the condition $$\frac{\partial V_{ref}}{\partial T} = 0$$

is needed. More particularly, $$\frac{R22}{R23} \cdot \frac{k}{q} \ln \frac{J1}{J2} - \frac{V_{g0}}{T_0} + \frac{V_{BE0}}{T_0} = 0 \,.$$

that is, $$V_{g0} = \frac{R22}{R23} \cdot \frac{kT_0}{q} \ln \frac{J1}{J2} + V_{BE0} \tag{7}$$

is a condition necessary for the variation of the reference voltage $V_{ref}$ due to an temperature to be 0.

Referring to the equations (1) and (2), the first term on the right side in the equation (7) indicates a drop voltage $V_{R22}$ of the resistor R22. The second term on the right side in the equation (7) indicates a base-emitter voltage of the transistor Q23. Thus, the entire right side in the equation (7) indicates a voltage between the terminals T3 and T2, that is, a reference voltage $V_{ref}$. Accordingly, in order for the equation (7) to be fulfilled so that the variation of the reference voltage due to a temperature becomes 0, $$V_{ref}=V_{g0} \quad (8)$$

must be fulfilled. More particularly, in the circuit shown in FIG. 2, the reference voltage $V_{ref}$ can be maintained constant with respect to a variation of a temperature by setting $V_{ref}=V_{g0}$.

As described in the foregoing, $V_{BE}$ has a negative temperature coefficient (refer to the equation (4)) and $\Delta V_{BE}$ has a positive temperature coefficient (refer to the equation (1)). Accordingly, if and when these two voltages are summed in such a manner that a voltage variation due to a temperature variation is cancelled, the summed voltage becomes independent of the temperature variation. This is a principle of the conventional reference voltage generating circuit as shown in FIG. 2.

In the conventional reference voltage generating circuit structured based on the principle, $V_{ref}=V_{g0}$ shown in the equation (8) must be fulfilled. Thus, only the value equal to an extrapolation voltage of an energy band gap can be selected as a reference voltage $V_{ref}$. For example, a semiconductor integrated circuit using a silicon can take only approximately 1.205 volts as a reference voltage, since an extrapolation voltage $V_{go}$ of an energy band gap of a silicon is 1.205 volts.

Thus, the conventional reference voltage generating circuit can have merely a single reference voltage value dependent on a semiconductor material. Thus, conventionally, in order to obtain a desired reference voltage needed in a circuit design, it is necessary to provide a level shifting circuit in a latter stage of a reference voltage generating circuit. Furthermore, in case where a voltage of a power supply is smaller than an extrapolation value of an energy band gap, there exits a serious problem that the above described conventional reference voltage generating circuit cannot be directly used.

SUMMARY OF THE INVENTION

The present invention is directed to a reference voltage generating circuit for generating a constant voltage independent of an environmental variation. The reference voltage generating circuit in accordance with the present invention comprises a first transistor, and a pair of second and third transistors the bases of which are connected to each other. A current density of the third transistor is made different from that of the second transistor. The reference voltage generating circuit in accordance with the present invention includes a first converting means for converting to a first current a first voltage between a base and an emitter of the first transistor; a second converting means for converting to a second current a second voltage which is a difference between base-emitter voltages of the second and third transistors; the ratio of the first current and the second current is made equal to the ratio of the first voltage and the second voltage and the current density of the second transistor is made different from the current density of the third transistor; means for synthesizing the first current and the second current to produce a third current; and converting means for converting the third current to a reference voltage.

In a preferred embodiment of the present invention, the first, second and third conversions are made, respectively, using a first, second and third resistors having the same temperature coefficient, respectively. Furthermore, the first and second converting means includes a negative feedback loop utilizing a current mirror.

Accordingly, the principle object of the present invention is to provide a reference voltage generating circuit which is capable of directly obtaining an arbitrary reference voltage needed in a circuit design.

Another object of the present invention is to provide a reference voltage generating circuit which is capable of a reference voltage even if a voltage value of a power supply is smaller than a extrapolation voltage value of an energy band gap of a semiconductor.

These objects and other objects, features, aspects and advantages of the present invention will become more apparent from the following detailed description of the present invention when taken in conjunction with the accompanying drawings.

DETAILED DESCRIPTION OF THE PRESENT INVENTION

Figure 3:
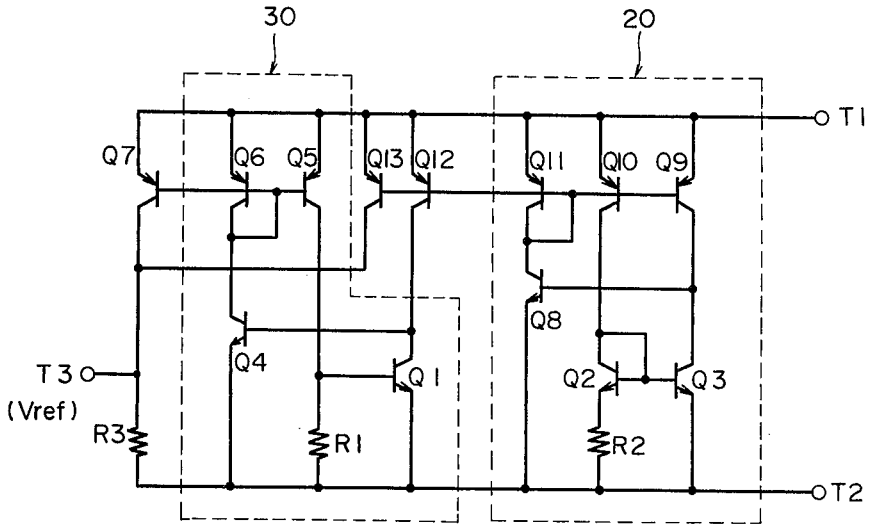
FIG. 3 shows one example of a basic circuit diagram for explaining a basic principle of a reference voltage generating circuit in accordance with the present invention.

FIG. 3 shows an example of a basic circuit diagram for explaining a basic principle of a reference voltage generating circuit in accordance with the present invention. Referring to FIG. 3, the basic principle of the present invention will be described in the following.

Fifth to seventh PNP transistors Q5–Q7, emitters of which are connected to a terminal T1 of a power supply, constitute a first current mirror. The sixth transistor Q6 has a collector and a base short-circuited so that it has a diode function. Collector currents of the fifth and seventh transistors Q5 and Q7 flow depending on a collector current of the sixth transistor Q6, respectively. Similarly, ninth to thirteenth PNP transistors Q9 and Q13 having emitters connected to the terminal T1 of a power supply, respectively, constitute a second current mirror. The eleventh PNP transistor Q11 has a collector and a base short circuited so that it has a diode function. Collector currents of four transistors Q9, Q10, Q12 and Q14 flow depending on a collector current of the eleventh transistor Q11.

A base of the second NPN transistor Q2 and a base of the third PNP transistor Q3 are connected to each other. Further, the second transistor Q2 has a collector and a base short-circuited so that it has a diode function. An emitter of the second transistor Q2 is connected to one end of the second resistor R2. The other end of the second resistor R2 is connected to an emitter of the third transistor Q3 and also to the ground terminal T2.

The collector of the second transistor Q2 is connected to the collector of the tenth transistor Q10 included in the second current mirror. The collector of the third transistor Q3 is connected to the collector of the ninth transistor Q9 included in the second current mirror.

Figure 1:
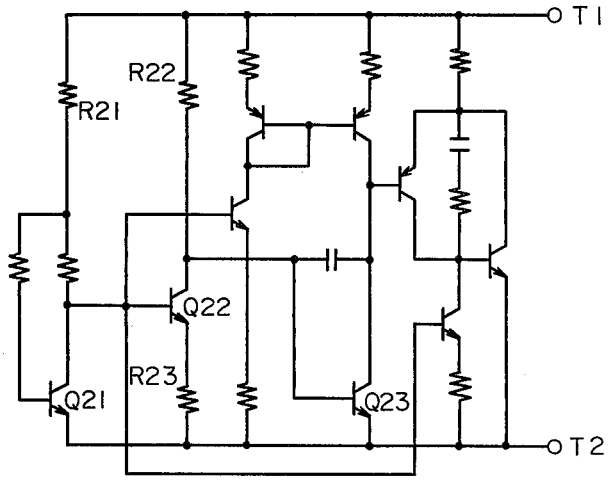
FIG. 1 PRIOR ART
FIG. 1 is a circuit diagram showing an example of a conventional reference voltage generating circuit.
Figure 2:
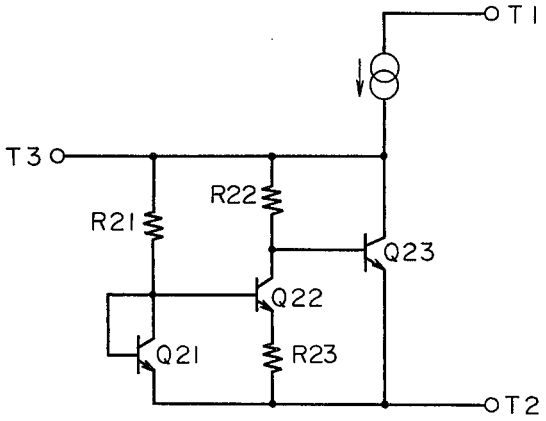
FIG. 2 PRIOR ART
FIG. 2 is a basic circuit diagram for explaining a basic principle of a conventional reference voltage generating circuit.

The third transistor Q3 is operated with a relatively large current density J1. On the other hand, the second transistor Q2 is operated with a relatively small current density J2. Following approaches are considered to set a current density to J1 and J2. The first one is an approach for appropriately selecting a ratio of a base-emitter junction area of the transistor Q9 and a base-emitter junction area of the transistor Q10. The second one is an approach for appropriately selecting a ratio of a base-emitter junction area of the transistor Q2 and a base-emitter junction area of the transistor Q3. Preferably, the current density J1 of the third transistor Q3 may be set to be approximately ten times as large as a current density J2 of the second transistor Q2. As a result, a suitable value of $\Delta V_{BE}$ can be obtained and thus it is easy to design a circuit. However, in theory, a circuit can be operated if $J1 > J2$. Reversibly to the structure shown, the second resistor R2 may be connected between the emitter of the third transistor Q3 and the ground terminal T2. This is the same structure as the conventional apparatus as shown in FIG. 2. In this case, it is necessary to make the current density of the second transistor Q2 larger than the current density of the third transistor Q3.

A region 20 surrounded in a dotted line in FIG. 3 shows a circuit for generating a current having a positive temperature coefficient. The basic principle is the same as the conventional one. The difference $\Delta V_{BE}$ between the base-emitter voltages of a pair of transistors Q2 and Q3 is represented by the following equation (9), as described in conjunction with a conventional technique.

$$\Delta V_{BE} = \frac{kT}{q} \ln \frac{J1}{J2} \tag{9}$$

The potential difference $\Delta V_{BE}$ is applied to the second resistor R2. Thus, a current $I_T$ represented by the following equation (10) flows into the resistor R2.

$$I_T = \frac{1}{R2} \cdot \Delta V_{BE} = \frac{1}{R2} \cdot \frac{kT}{q} \ln \frac{J1}{J2} \tag{10}$$

As clear from the equation (10), the current $I_T$ has a positive temperature coefficient with respect to an absolute temperature T.

In a preferred embodiment of the present invention shown in FIG. 3, in order to stably generate a current $I_T$ having a positive temperature coefficient, there is provided a negative feedback loop circuit as described in the following. More particularly, a current of the second current mirror determined in a manner described in the following is applied to a base of the eighth transistor Q8 for a current amplification, together with the third transistor Q3 through the ninth transistor Q9. Accordingly, an amplified collector current flows into the transistor Q8. The collector current of the transistor Q8 is a collector current of the reference transistor Q11 of the second current mirror. In such a way, a current of the second current mirror is controlled by a current amplifying transistor Q8 and a reference transistor Q3 in the second current mirror. The current of the second current mirror thus determined is applied to the second transistor Q2 through the tenth transistor Q10 and also is applied to the third transistor Q3 and the base of the eighth transistor Q8 through the ninth transistor Q9 as described in the foregoing. The collector current of the second transistor Q2 thus applied is a base current of the third transistor Q3. If and when the current becomes larger, the collector current of the third transistor Q3 becomes larger. Thus, a current applied to the base of the current amplifying transistor Q8 becomes smaller. For this reason, the collector current of the transistor Q8, that is, the current of the second current mirror decreases. Therefore, a current applied to the second transistor Q2 through the transistor Q10 in the second current mirror also decreases. In such a way negative feedback loop is structured.

In the above described manner, a stable current is applied to a pair of transistors Q2 and Q3. Thus, the current density J2 of the transistor Q2 and the current density J3 of the transistor Q3 take a stable value. As a result, the difference $\Delta_{BE}$ between the base-emitter voltages of these two transistors becomes a stable value. In such a way, a current $I_T$ having a positive temperature coefficient determined by the potential difference $\Delta V_{BE}$ and the value of the resistor R2 is stably generated. In other words, a current in each portion of the second current mirror is determined by the potential difference $\Delta V_{BE}$ and the resistor R2. Accordingly, the current of the second current mirror is represented by the following equation (11) wherein m is a proportion constant.

$$m \cdot I_T \tag{11}$$

The proportion constant m can be properly set by, for example, changing a base-emitter junction area of each transistors in the second current mirror.

In principle, it is possible to generate or produce a current $I_T$ having a positive temperature coefficient without using the second current mirror and a current amplifying transistor Q8, because a current having a positive temperature coefficient flows into the resistor R1 by flowing a constant current into a pair of transistors Q2 and Q3. Hence, a current from a constant current regulated power may be supplied to the transistors Q2 and Q3. In such case, a current flowing into the resistor R1 may be directly withdrawn as a current having a positive temperature coefficient.

However, a preferred embodiment of the present invention shown in FIG. 3 constitutes a negative feedback loop using a current mirror and a current amplifying transistor, so that a current $I_T$ having a positive temperature coefficient is stably produced. Advantages of the embodiment are as follows. First, it is possible to reduce a consumed current since all the current flows through a current mirror. Secondly, the potential of the collector of the transistor Q3 does not fluctuate so largely since the potential is determined by a base potential of a current amplifying transistor Q8. Thus, a stable potential difference $\Delta V_{BE}$ between a base and an emitter can be obtained, since a circuit can be operated with a collector potential of the transistor Q2 being equal to the collector potential of the transistor Q3. For this reason, even if a fluctuation of a voltage of a power supply is so large and so frequent, an extremely stable reference voltage can be obtained.

A region 30 surrounded in a dotted line in FIG. 3 indicates a circuit for generating or producing a current having a negative temperature coefficient. The collector of the first NPN transistor Q1 is connected to the base of the fourth NPN transistor Q4 and the collector of the twelfth transistor Q12 in the second current mirror is connected to the junction thereof. The collector of the fourth transistor Q4 is connected to the collector of the sixth transistor Q6 in the first current mirror and the emitter thereof is connected to the ground terminal T2. The base of the first transistor Q1 is connected to the collector of the fifth transistor Q5 in the first current mirror and one end of the first transistor R1. The other end of the first resistor R1 and the emitter of the first transistor Q1 are connected to the ground terminal T2, respectively.

In the above described structure, the above described current $m \cdot I_T$ of the second current mirror is applied from the collector of the twelfth PNP transistor Q12 in the second current mirror to the collector of the first NPN transistor Q1 and the base of the fourth NPN transistor Q4. The constant m in this case is set by appropriately determining the ratio of a base-emitter junction area of the reference transistor Q11 and a base-emitter junction area of the twelfth transistor Q12 in the second current mirror.

If and when a current amplification factor of the current amplifying transistor Q4 is sufficiently large, most of the current $m \cdot I_T$ is applied to the first transistor Q1. By this current, the base-emitter voltage $V_{BE}$ of the first transistor Q1 is set. The voltage $V_{BE}$ is represented in a simplified manner by the following equation (12), as described in conjunction with the conventional technique.

$$V_{BE} = V_{g0}\left(1 - \frac{T}{T_0}\right) + V_{BE0} \cdot \frac{T}{T_0} \tag{12}$$

The voltage $V_{BE}$ is applied to the first resistor R1. As a result, a current $I_\beta$ represented by the equations (13) and (14) flows into the resistor R1.

$$I_\beta = \frac{1}{R1} \cdot V_{BE} \tag{13}$$

$$= \frac{1}{R1}\left\{V_{g0}\left(1 - \frac{T}{T_0}\right) + V_{BE0} \cdot \frac{T}{T_0}\right\} \tag{14}$$

As obvious from the equation (14), the current $I_\beta$ has a negative temperature coefficient with respect to an absolute temperature T.

In order to stably generate the current $I_\beta$ having the negative temperature coefficient, a negative feedback loop is provided just as the case where the above described current $I_T$ having the positive temperature coefficient is produced. More particularly, a current of the first current mirror is controlled by the current amplifying transistor Q4 and the reference transistor Q6 of the first current mirror. The current is applied to the base of the first transistor Q1 and the first resistor R1 through the fifth transistor Q5. The current applied to the resistor R1 is a current $I_\beta$ flowing into the resistor R1 based on the base-emitter voltage $V_{BE}$ of the first transistor Q1. If the current increases, the collector current of the first transistor Q1 increases and the current applied to the base of the current amplifying transistor Q4 decreases. Accordingly, the current of the first current mirror decreases.

Thus, a current having a negative temperature coefficient is stably generated. More particularly, a current of each portion of the first current mirror is determined by the base-emitter voltage $V_{BE}$ of the first transistor Q1 and the first resistor R1. Hence, the current of the first current mirror is represented by $$a \cdot I_\beta \tag{15}$$

wherein a is a proportion constant. The proportion constant a can be properly determined by changing a base-emitter junction area of each transistor included in the first current mirror, for example.

In order to maintain the base-emitter voltage $V_{BE}$ constant, it is necessary to maintain the collector current of the first transistor Q1 as much as possible. Thus, in the present embodiment, a current of the second current mirror is supplied as a collector current of the transistor Q1 through the transistor Q12. However, if and when a constant current regulated source is separately provided, a current from the constant current regulated source may be applied to the transistor Q1. In such case, between the transistors Q1 and Q4 and a power source terminal T1, a constant current regulated source may be provided instead of the transistor Q12.

Then, the current $I_T$ having a positive temperature coefficient and the current $I_\beta$ having a negative temperature coefficient, as produced in the above described manner are synthesized. More particularly, a collector of the seventh transistor Q7 in the first current mirror is connected to the thirteenth transistor Q13 in the second current mirror. The junction thereof is connected to an output terminal T3 of a reference voltage and also is connected to the ground terminal T2 through the third resistor R3. Accordingly, a current $a \cdot I_\beta + m \cdot I_T$, the sum of the current $a \cdot I_\beta$ of the first current mirror represented by the equation (15) and the current $m \cdot I_T$ in the second current mirror represented by the equation (11), flows. The proportion constant a in this case can be set to an appropriate value by properly selecting the ratio of the base-emitter junction area of the sixth transistor Q6 and the base-emitter junction area of the seventh transistor Q7 in the first current mirror. Also, the proportion constant m in this case can be set to an appropriate value by properly selecting the ratio of the base-emitter junction area of the eleventh transistor Q11 and the base-emitter junction area of the thirteenth transistor Q13 in the second current mirror.

In such a way, a reference voltage $V_{ref}$ represented by the following equation (16) is generated between both ends of the third resistor R3.

$$V_{ref} = R3(a \cdot I_\beta + m \cdot I_T) \tag{16}$$

Substituting the equations (10) and (13) for the equation (16), the equation (16) is modified in the following.

$$V_{ref} = R3\left(\frac{a}{R1} \cdot V_{BE} + \frac{m}{R2} \cdot \Delta V_{BE}\right) \tag{17}$$

For the purpose of more simplicity, setting a=m=1, the equation (17) is simplified in the following.

$$V_{ref} = \frac{R3}{R1} \cdot V_{BE} + \frac{R3}{R2} \cdot \Delta V_{BE} \tag{18}$$

Referring to the equations (9) and (12), the equation (18) is further modified in the following.

$$V_{ref} = \frac{R3}{R1}\left\{V_{g0}\left(1 - \frac{T}{T_0}\right) + V_{BE0}\left(\frac{T}{T_0}\right)\right\} + \frac{R3}{R2}\cdot\frac{kT}{q}\ln\frac{J1}{J2} \quad (19)$$

Then, in order to evaluate a temperature coefficient of the equation (19), the equation (19) is differentiated with respect to an absolute temperature T. As a result, the following equation (20) is obtained.

$$\frac{\partial V_{ref}}{\partial T} = \frac{R3}{R1}\left(-\frac{V_{g0}}{T_0} + \frac{V_{BE0}}{T_0}\right) + \frac{R3}{R2}\cdot\frac{k}{q}\ln\frac{J1}{J2} \quad (20)$$

Assuming that the right side of the equation (20) is 0, the following condition can be extracted.

$$V_{g0} = V_{BE0} + \frac{R1}{R2}\cdot\frac{kT_0}{q}\ln\frac{J1}{J2} \quad (21)$$

Modifying the equation (21), the following equation (22) is obtained.

$$\frac{V_{g0}}{R1} = \frac{V_{BE0}}{R1} + \frac{\frac{kT_0}{q}\ln\frac{J1}{J2}}{R2} \quad (22)$$

Dividing both sides of the equation (22) by $I_\beta$, the following equation (23) is obtained.

$$\frac{V_{g0}}{I_\beta R1} = \frac{V_{BE0}}{I_\beta R1} + \frac{1}{I_\beta}\cdot\frac{\Delta V_{BE}}{R2} \quad (23)$$

Using the equations (10) and (13), the equation (23) is modified in the following.

$$\frac{V_{g0}}{V_{BE0}} = 1 + \frac{1}{I_\beta}\cdot I_T \quad (24)$$

$$\therefore \frac{V_{g0} - V_{BE0}}{V_{BE0}} = \frac{I_T}{I_\beta} \quad (25)$$

Setting $V_T = V_{g0} - V_{BE0}$, $$\frac{V_T}{V_{BE0}} = \frac{I_T}{I_\beta} \quad (26)$$

The equation (26) indicates that the synthesized current of the first current $I_\beta$ having a negative temperature coefficient and the second current $I_T$ having a positive temperature coefficient is temperature compensated when the ratio of the first current $I_\beta$ and the second current $I_T$ is equal to the ratio of the voltage $V_{BE}$ and the voltage $V_T = V_{g0} - V_{BE0}$.

In the first converting means and the second converting means, the first resistor R1 and the second resistor R2 are used, respectively, to convert a voltage to a current. The third resistor R3 is used as the third converting means for converting to a reference voltage the third current which is a synthesized current of the first and second currents. Accordingly, in order to cancel the temperature coefficients of the respective resistors, it is necessary for temperature coefficients of the resistors R1, R2 and R3 to be all equal. If and when the reference voltage generating circuit is structured in a semiconductor integrated circuit, this condition can be easily fulfilled. However, even if the reference voltage generating circuit is not manufactured in the semiconductor integrated circuit, it is possible to fulfill the condition.

Figure 4:
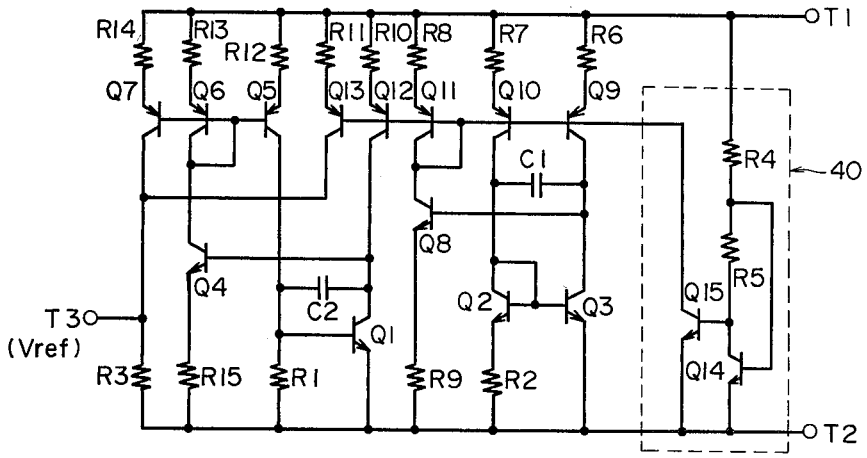
FIG. 4 is a modified circuit diagram wherein the basic circuit of the reference voltage generating circuit shown in FIG. 3 in accordance with the present invention is modified to a practical circuit.

Turning to FIG. 4, a circuit shown in FIG. 4 is a modified circuit wherein a basic circuit of the reference voltage generating circuit in accordance with the present invention as shown in FIG. 3 is modified to a practical circuit. Resistors R6 to R14 are connected, respectively, between a terminal T1 of a power supply and an emitter of each of transistors constituting the first and second current mirrors. These resistors are balanced resistors for operating the first and second current mirrors in a stable manner.

A start circuit for a circuit producing a current having a positive temperature coefficient as shown in the region 20 surrounded in a dotted line in FIG. 3 is shown in the region 40 surrounded in a dotted line. A resistor R9 connected between the emitter of the transistor Q8 and a ground terminal T2, and a capacitor C1 connected between the collector of the transistor Q9 and the collector of the transistor Q10 constitute a phase compensating circuit for a circuit producing a current having a positive temperature coefficient. A resistor R15 connected between the emitter of the transistor Q4 and the ground terminal T2 and a capacitor C2 connected between the collector and the base of the transistor Q1 constitute a phase compensating circuit for a circuit producing a current having a negative temperature coefficient.

In operation, a power voltage is applied between the terminals T1 and T2. As a result, first, a very small current is applied to the base of the second current mirror by the "start circuit". Then, the circuit producing a current having a positive temperature coefficient begins to operate and a current having a positive temperature coefficient flows from each collector of the transistors Q12 and Q13. A current from the collector of the transistor Q12 causes the circuit producing a current having a negative temperature coefficient to begin to operate, so that a current having a negative temperature coefficient flows from the collector of the transistor Q7. Thus, the current having a positive temperature coefficient and the current having a negative temperature coefficient are synthesized and the synthesized current is applied to the resistor R3 so that the corresponding voltage is generated. The voltage is withdrawn between the terminals T3 and T2 thereby to obtain a temperature compensated reference voltage.

In accordance with the reference voltage generating circuit of the present invention, a temperature compensated and very stable voltage to fluctuation of a voltage of a power supply can be obtained. Further, it is possible to reduce a consumed current since all of the current other than a current flowing to the resistor R4 in the driving start circuit (40) flows through a current mirror. If and when the reference voltage generating circuit of the present invention is manufactured in a semiconductor integrated circuit, the circuit can be operated with a lower voltage of a power supply than an extrapolation voltage $V_{g0}$ of an energy band gap of the semiconductor used as a semiconductor material. In general, in case of silicon (Si), $V_{g0}$ is equal to 1.205 volts; however, an operation is achieved without any deterioration of characteristic, even if the voltage of a power supply is reduced to an approximate 0.9 volts in accordance with the inventive circuit. Furthermore, in accordance with the present invention, it is a great meritorious effect that the desired reference voltage is freely produced within a range of a voltage of a power supply.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A reference voltage generating circuit for generating a constant voltage independent of an environmental change, including a first transistor and a pair of a second and a third transistors the bases of which are connected to each other; comprising first converting means (30) for converting a first voltage which is a base-emitter voltage of said first transistor to a first current, second converting means for converting to a second current a second voltage which is a difference voltage between a base-emitter voltage of said second transistor and a base-emitter voltage of the third transistor, a ratio of said first current and said second current being made equal to the ratio of the first voltage and a voltage that said first voltage is subtracted from an extrapolation voltage of an energy band gap of a semiconductor material of said first, second and third transistors, a current density of said second transistor being made equal to a current density of said third transistor, means for synthesizing said first current and said second current for generating a third current; and third converting means for said third current to a reference voltage.

2. A reference voltage generating circuit in accordance with claim 1, which is formed in a semiconductor integrated circuit.

3. A reference voltage generating circuit in accordance with claim 1, wherein said first converting means includes a first resistor, said first resistor being connected to a base of said first transistor so that said first current flows, said second converting means includes a second resistor, said second resistor being connected to an emitter of one of said second and third transistors, which has a smaller current density than that of another one, so that said second current flows, said third converting means includes a third resistor, said third current being applied to said third resistor so that a reference voltage is withdrawn from both ends of said third resistor, and temperature coefficients of said first, second and third resistors are made equal to each other.

4. A reference voltage generating circuit in accordance with claim 1 wherein said first converting means includes a fourth transistors and a first current mirror including fifth to seventh transistors wherein the sixth transistor having a diode function is used as a reference, a voltage of a power supply being applied to emitters of said fifth to seventh transistors, a collector of said sixth transistor being connected to a collector of said fourth transistor, a base of said fourth transistor being connected to a collector of said first transistor, a base of first transistor being connected to a collector of said fifth transistor and one end of said first resistor, the other end of said first resistor, an emitter of said fourth transistor and an emitter of said first transistor being connected to the ground, said second converting means includes a eighth transistor and a second current mirror including ninth to thirteenth transistors wherein said eleventh transistor having a diode function is used as a reference, a voltage of a power supply being applied to emitters of said ninth to thirteenth transistors, a collector of said eleventh transistor being connected to a collector of said eighth transistor, a base of said eighth transistor being connected to a junction of a collector of said ninth transistor and a collector of said third transistor, a collector of said tenth transistor being connected to a collector of said second transistor, the emitter of said second transistor being connected to a ground through said second resistor, the emitter of said eighth transistor and the emitter of said third transistor being connected to the ground, a collector of said twelfth transistor being connected to a junction of a collector of said first transistor and a base of said fourth transistor, said means producing said third current sums collector currents of the seventh and the thirteenth transistors by connecting the collector of the seventh transistor to the collector of the thirteenth transistor, and one end of said third resistor is connected to a junction of the collector of said seventh transistor and the collector of said thirteenth transistor and the other end thereof is connected to the ground.

5. A reference voltage generating circuit in accordance with claim 1 wherein said first converting means includes a fourth transistors and a first current mirror including fifth to seventh transistors wherein the sixth transistor having a diode function is used as a reference, a voltage of a power supply being applied to emitters of said fifth to seventh transistors, a collector of said sixth transistor being connected to a collector of said fourth transistor, a base of said fourth transistor being connected to a collector of said first transistor, a base of first transistor being connected to a collector of said fifth transistor and one end of said first resistor, the other end of said first resistor, an emitter of said fourth transistor and an emitter of said first transistor being connected to the ground, said second converting means includes a eighth transistor and a second current mirror including ninth to thirteenth transistors wherein said eleventh transistor having a diode function is used as a reference, a voltage of a power supply being applied to emitters of said ninth to thirteenth transistors, a collector of said eleventh transistor being connected to a collector of said eighth transistor, a base of said eighth transistor being connected to a junction of a collector of said ninth transistor and a collector of said third transistor, a collector of said tenth transistor being connected to a collector of said second transistor, the emitter of said eighth transistor and the emitter of said second transistor being connected to the ground, the emitter of said third transistor being connected to a ground through said second resistor, a collector of said twelfth transistor being connected to a junction of a collector of said first transistor and a base of said fourth transistor, said means producing said third current sums collector currents of the seventh and the thirteenth transistors by connecting the collector of the seventh transistor to the collector of the thirteenth transistor, and one end of said third resistor is connected to a junction of the collector of said seventh transistor and the collector of said thirteenth transistor and the other end thereof is connected to the ground.

* * * * *